US005309616A

United States Patent [19]

Sobin

[11] Patent Number: 5,309,616

[45] Date of Patent: May 10, 1994

[54] METHOD OF MAKING A CATCH FOR JEWELRY CLASP

[75] Inventor: Donald J. Sobin, Springfield, N.J.

[73] Assignee: Do-All J.M.C. Inc., Springfield, N.J.

[21] Appl. No.: 963,557

[22] Filed: Oct. 20, 1992

Related U.S. Application Data

[62] Division of Ser. No. 721,248, Jun. 26, 1991, abandoned.

[51] Int. Cl.[5] ..... B23P 13/00

[52] U.S. Cl. ..... 29/160.6; 29/172; 29/173; 24/616

[58] Field of Search ..... 29/160.6, 172, 173; 24/614, 615, 616; 72/379.2

[56] References Cited

U.S. PATENT DOCUMENTS

| | | | |
|---|---|---|---|
| 393,222 | 11/1988 | Elleau | 24/616 |
| 856,480 | 6/1907 | Long | 24/616 |
| 1,259,544 | 3/1918 | Megurowsky . | |
| 1,393,222 | 10/1921 | Jaroll | 24/616 |
| 1,626,720 | 5/1927 | Chayes | 29/160.6 |
| 2,340,708 | 2/1944 | Stern | 24/616 |
| 3,308,517 | 3/1967 | Geldwerth | 24/616 |
| 3,359,606 | 12/1967 | Geldwerth | 24/616 |
| 4,170,809 | 10/1979 | Geldwerth | 24/616 |
| 4,543,692 | 10/1985 | Ode et al. | 24/616 |
| 4,667,378 | 5/1987 | Sturm | 24/616 |
| 4,672,724 | 6/1987 | Grotto | 24/616 |
| 4,697,315 | 10/1987 | Geldwerth | 24/616 |

FOREIGN PATENT DOCUMENTS

| | | | |
|---|---|---|---|
| 213196 | 8/1908 | Fed. Rep. of Germany . | |
| 261055 | 8/1912 | Fed. Rep. of Germany . | |
| 472684 | 12/1914 | France | 24/616 |
| 197321 | 8/1990 | Japan | 72/379.2 |

*Primary Examiner*—P. W. Echols

*Attorney, Agent, or Firm*—Sandler Greenblum & Bernstein

[57] ABSTRACT

A catch for a jewelry clasp is disclosed which is formed from a single strip of dual thickness metal. A pushing member, having a second thickness which is preferably around three times the thickness of the first thickness portion of the tongue, is pressed to release the catch from a clasp to allow a wearer to remove an article of jewelry. Also disclosed is a method of making the catch where a dual thickness blank is formed by pressing a single thickness starting blank with a series of dies. A second method of making the catch is disclose where dual thickness blanks are cut from a ribbon of dual thickness metal stock.

8 Claims, 7 Drawing Sheets

METHOD OF MAKING A CATCH FOR JEWELRY CLASP

This application is a division of application Ser. No. 07/721,248, filed Jun. 26, 1991 now abandoned.

BACKGROUND OF THE INVENTION

1. Field of the Invention

The present invention concerns clasps for jewelry of the type used for securing necklaces and bracelets to the wearer. More particularly, the invention relates to improved catches for use in jewelry clasps of the types mentioned above.

2. Description of Background Invention

Virtually all necklaces and bracelets are secured to the wearer by means of a clasp. A very popular clasp is described in U.S. Pat. No. 3,359,606. The male member, also known as the tongue or catch, for that clasp is stamped from a flat metal strip of uniform thickness, and therefore, the tongue itself is of uniform thickness throughout.

The upright member of the tongue, which acts as a release for the clasp, is folded over on top to form a surface for pushing on to effect release of the tongue from its mating portion of the clasp. The folded portion projects substantially above the top of the assembled clasp and is necessary for facilitating an easy release of the clasp.

Inherent problems exist with the folded upright tongue release. The significant projection of the tongue out of the clasp detracts significantly from the aesthetics of the clasp and the bracelet as a whole. Further, since the folded portion is open at the bottom, it may catch on fabric or on other jewelry. Still further, once constructed the upright projection must remain at the same height regardless of the height of the chain to which the clasp is attached, since the loop of the fold is at the top of the projection, and any attempt at shortening the projection would result in a bisection of the folded piece. Thus, the folded upright portion cannot be trimmed to blend with the attached chain.

In an attempt to overcome the above-mentioned problems, a clasp has been devised wherein the folded over, upright portion of the tongue or catch has been replaced by a thick piece of metal which is soldered onto the remainder of the tongue. The result is a thickened portion of the tongue that sticks upright and forms a pushing surface by which the clasp can be released. This design eliminates the possibilities of the upright member of the tongue catching on fabric or other jewelry, and also this upright portion can be trimmed to match the height of the attached chain. This type of tongue has its own inherent problems, however.

The attachment of the thickened upright member to the remaining portion of the tongue by soldering introduces excessive heat to the tongue portion thereby taking some of the temper out of the spring portion of the tongue. Thus, the tongue portion loses some of its elasticity and ability to latch the clasp effectively. Further, there is a possibility of the thickened member becoming detached from the tongue since the solder joint is more likely to break than an integral strip of metal, thereby making it impossible, or at least much more difficult to release the clasp and remove the item of jewelry. The solder joint may also fatigue or be defective from the outset. Still further, a tongue having a solder joint is aesthetically inferior to a tongue constructed from an integral strip of metal.

SUMMARY OF THE INVENTION

One advantage of the present invention is achieved by providing a catch for a jewelry clasp which is made from a dual thickness piece of metal, wherein a thicker upright portion is adapted to be pushed to release a thinner latching portion of the catch from the clasp. Since there is no requirement to solder the upright portion to the latching portion, none of the original temper or elasticity of the latching portion is lost and therefore the spring action of the latching portion is improved over that of the prior art.

Another advantage of the present invention over the soldered prior art catch is that the possibility of the thick upright member coming apart from the latching portion is eliminated. Thus, the annoying situation of not being able to remove an article of jewelry because the clasp catch has lost its actuating member is avoided.

Further, the catch of the present invention provides a comfortable, attractive pushing surface which is easily actuated to release the clasp, and can be trimmed to match the height of the attached chain.

Accordingly, it is one object of the present invention to provide a catch having a latching portion of one thickness and an upright member which is thicker than the latching portion and provides a pushing surface for actuating the catch. The catch is formed from a single piece of metal which has a dual thickness.

It is another object of the present invention to provide a method of forming a catch for a jewelry clasp wherein a starting blank is pressed to achieve a dual thickness within the blank, before the final blanking of the tongue shape. The intermediate or semi-blank is further pressed and blanked to the proper shape and is then bent to form a generally V-shaped latching portion attached to a thickened upright portion. The entire catch is formed from one integral piece of stock.

It is a further object of the present invention to provide a method by which pairs of final blanks may be cut from a ribbon of dual thickness stock. The pairs of final blanks are then bisected and bent into final form so that each blank produces a generally V-shaped latching portion attached to a thickened upright portion.

Other objects and advantages of the present invention and advantageous features thereof will become apparent as the description proceeds herein.

Included in the description is a catch for a jewelry clasp including a dual thickness strip of metal wherein a portion of the strip has a first thickness and forms a latching portion and a portion of the strip has a second thickness and forms a pushing member for actuating the catch. The second thickness differs from the first thickness by an amount generally defined by the following equation:

$$T\delta^{\text{"}}\Sigma^{x}{}_{n=1}\,(1/PDt_n)$$

wherein:

$T_{67}$ = the difference in thickness in inches;

P = pressure in tons per square inch;

D = a measure of ductility of the strip in inches per ton-second;

t = time in seconds;

n = index of current pressing step being carried out; and x = total number of pressing steps.

The catch is formed from an integral strip of dual thickness metal. The second thickness is greater than the first thickness, generally by 1.5 to 5 times, more particularly by 2 to 4 times and most preferably by around 3 times.

The first thickness portion of the strip is bent backwardly upon itself in a substantial V-shape to form the latching portion of the catch. The latching portion has an upper member and a lower member and the pushing member of the catch is substantially perpendicular to the upper member and is integral with the upper member.

The lower member of the latching portion is bent at a substantially right angle to provide an end portion and the upper member is integral with the pushing member, which is the thickened portion of the integral strip. The upper member is recessed adjacent the pushing member to form a locking portion. The catch optionally may further include means for joining a safety lock with the catch. The means for joining is attached to the end portion of the catch and is preferably a cylindrical member which is formed from a piece of metal tubing.

The catch is further disclosed as being formed from an integral dual thickness strip of metal.

One method of making a dual thickness catch for a clasp is disclosed to include: stamping a wire or flat metal strip having uniform thickness to form a starting blank; forming a semi-blank by pressing the starting blank to achieve a dual thickness within the semi-blank; forming a final blank comprising recesses in the strip at a location adjacent the boundary of the two different thicknesses; and bending the final blank to form a substantially V-shaped tongue having a first thickness and a substantially upright pushing member which has a second thickness which is greater than the first thickness.

This method uses pressing steps with pressures which are generally defined by the following empirically derived equation:

$$T\delta = \Sigma^{x}{}_{n=1} (1/PDt_n)$$

wherein:

$T_\delta$ = said difference in thickness in inches;

P = pressure in tons per square inch;

D = a measure of ductility of said blank in inches per ton-second;

t = time in seconds;

n = index of current pressing step being carried out; and x = total number of pressing steps.

Further according to the first method mentioned above, the starting blank is substantially rectangular, is placed in a die and pressed to form the semi-blank, which is substantially spoon-shaped. The semi-blank is then pressed to substantially flatten the semi-blank to form an approximate final blank. The approximate final blank is next cut to form a final blank having a precise shape for bending into a catch. An annealing step may be carried out after each pressing step.

The method produces a catch having a second thickness which is about 1.5 to 5 times greater than the first thickness, preferably about 2 to 4 times greater than the first thickness, and most preferably around three times greater than the first thickness.

A second method of making a dual thickness catch for a clasp is disclosed as including: cutting a strip of material from a sheet of stock material which has a first thickness portion and a second thickness portion to obtain a dual thickness strip; cutting the dual thickness strip substantially perpendicularly to the first cut to form two dual thickness strips of substantially equal proportions; bending the first thickness portion of each strip to form a substantially V-shaped tongue wherein the portion of the metal strip having the second thickness is integral with one end of the V-shape; bending the second thickness portion to form a pushing member, wherein the pushing member is substantially perpendicular to the tongue portion.

The second thickness portion is thicker than the first thickness portion, generally by 1.5 to 5 times, more particularly by 2 to 4 times and most preferably by around 3 times.

Also disclosed is a jewelry clasp including the catch described above, having a dual thickness strip of metal wherein a portion of the strip having a first thickness forms a latching portion and a portion of the strip having a second thickness forms a pushing member for actuating the catch; and a keeper which mates with the catch to secure the clasp.

Further disclosed is an article of jewelry which includes a catch according to the present invention, made from a dual thickness strip of metal wherein a portion of the strip having a first thickness .forms a latching portion and a portion of the strip having a second thickness forms a pushing member for actuating the catch. A keeper which mates with the catch enables securement of the article of jewelry. The article of jewelry further includes means for ornamenting a wearer, such as a chain, which is attached to the keeper and the catch.

BRIEF DESCRIPTION OF THE DRAWINGS

The present invention is further explained in the description which follows with reference to the drawings, illustrating, by way of non-limiting examples, various embodiments of the invention, with like reference numerals representing similar parts throughout the several views, and wherein.

DESCRIPTION OF THE PREFERRED EMBODIMENTS

Figure 1:
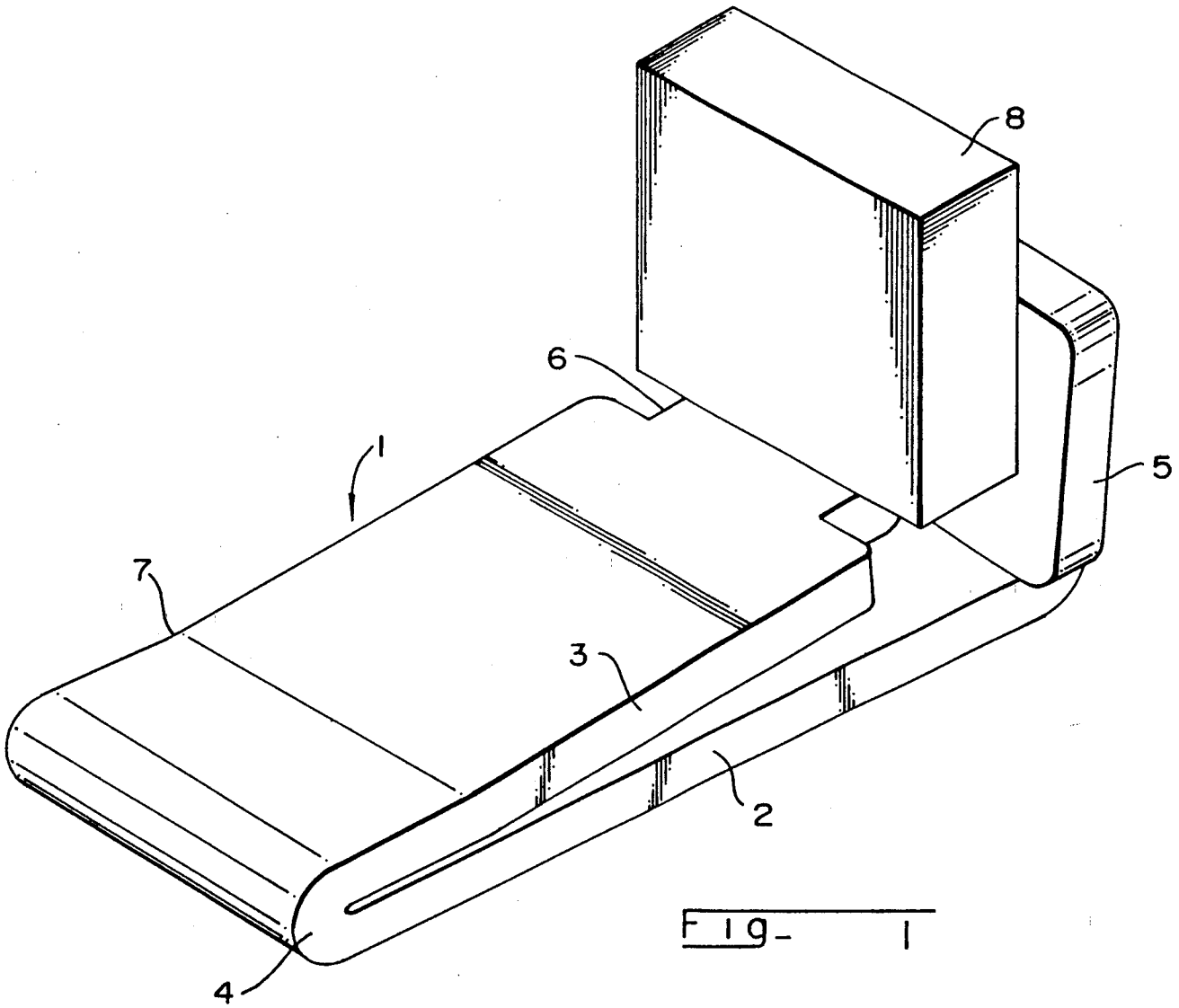
FIG. 1 is a plan view of a tongue or catch or male member of a jewelry clasp according to the present invention (the terms tongue, catch and male member are used interchangeably herein)

Referring now to the drawings in detail, FIG. 1 shows a plan view of a completed catch according to the present invention. Catch 1 is formed from a single strip of dual thickness metal. The first thickness portion of the strip is bent as shown as bend 4 to form a substantially V-shaped resilient, latching portion or tongue which is adapted to be inserted into a keeper or female portion of a clasp. The V-shaped latching portion is comprised of a generally elongated overlying latching portion 3 and a generally elongated underlying portion 2. As will be explained below, the overlying latching portion includes a pair of oppositely positioned locking recesses 6 for engagement with a mating keeper.

Lower portion 2 is bent at the end opposite the V-bend of the latching portion, to form end member 5 having a first thickness. End 5 is wider than lower portion 2, so as to generally match the width of the keeper that fits over the latching portion. End 5 is substantially perpendicular to lower portion 2.

Upper portion 3 is unitary with a second thickness portion of the metal strip at the end of upper portion 3 which is opposite the V-bend of the latching portion. The metal strip is bent at a substantial right angle at the juncture of the first and second thicknesses to form a thick upright member 8 at the end of upper portion 3. Thick upright member 8 is also referred to as push bar 8 or pushing member 8. Push bar 8 is of a second thickness which is greater than the above-identified first thickness which characterizes the remainder of the catch. The additional thickness of push bar 8 makes the end more easily accessible and more comfortable for the user to operate, i.e., the user pushes on the end of push bar 8 to release the catch from the keeper and thereby open the clasp. The thickness of push bar member is generally 1.5 to 5 times greater than the first thickness of the catch, more preferably 2 to 4 times greater, and most preferably about three times greater.

Adjacent the right angle bend between upright member 8 and upper latching portion 3, upper latching portion 3 has a pair of recesses 6 which lock catch 1 into a keeper until upright member 8 is pushed to release the latch.

Upper latching portion 3 is slightly bent at 7 away from lower latching portion 2 to create greater travel and spring force between the upper and lower latching portions.

Figure 2A:
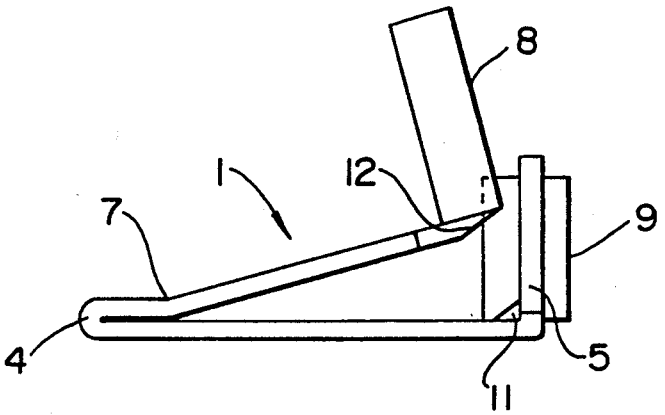
FIGS. 2A–2C are side, top and end views, respectively, of the catch according to the present invention.
Figure 2B:
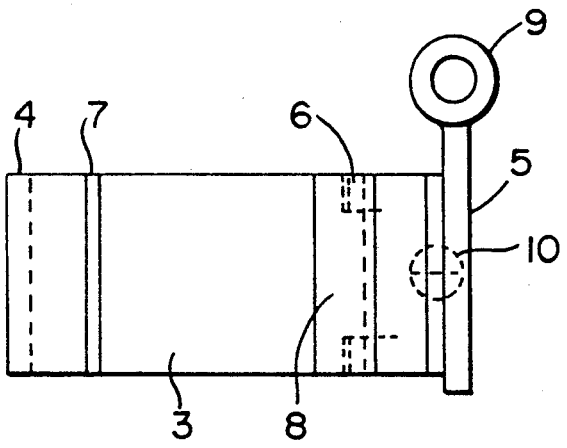
Figure 2C:
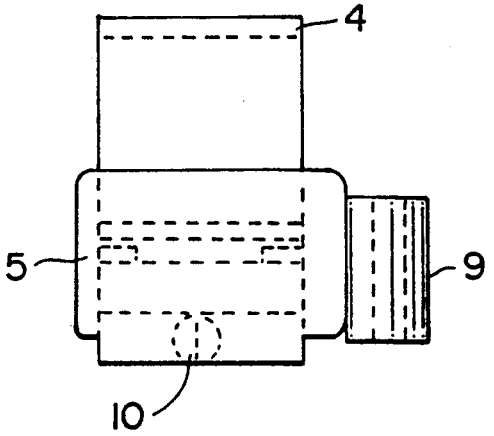

FIGS. 2A–2C show side, top and end views respectively. Bend 7, as described previously, is more readily apparent in the view shown in FIG. 2A. End 5 is reinforced by gusset 10, as shown in FIGS. 2B and 2C and which protrudes through the joint between lower member 2 and end 5 at 11 as shown in FIG. 2A. Gusset 10 is disclosed in more detail in U.S. Pat. No. 4,697,315, which was incorporated by reference above.

Catch 1 may optionally include cylindrical member 9 which serves as a hinge for a figure-eight safety lock for the clasp. Cylinder 9 is preferably soldered to end member 5 and is preferably formed from a piece of round metal tubing.

Figure 3:
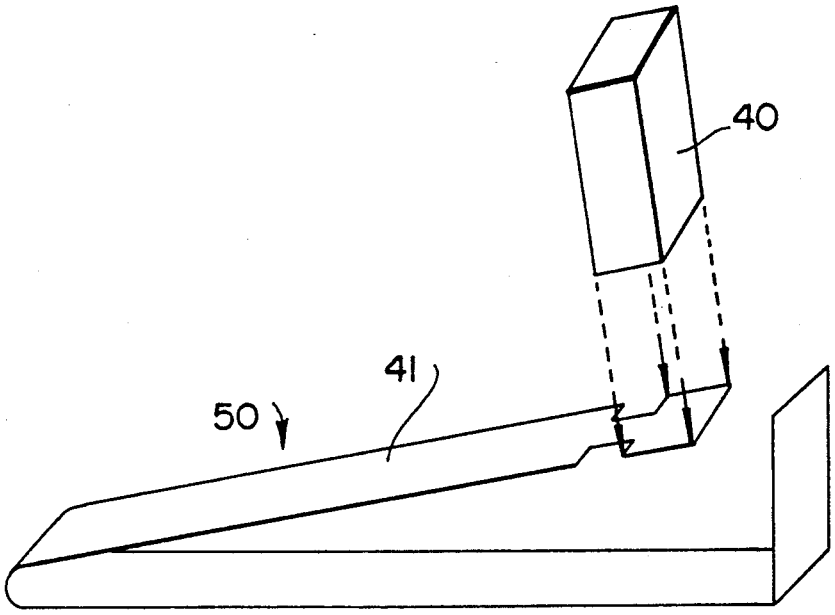
Fig- 3 PRIOR ART
FIG. 3 is a plan view of a catch that is known in the prior art.

FIG. 3 is a plan view of the prior art and shows that the push bar 40 is soldered to the latching portion 41 of the catch. The inherent problems with this type of catch that the present invention overcomes, as discussed previously, are that soldering the push bar to the latching portion takes some or all of the temper out of the latching portion thereby causing it to lose some or all of its resiliency and possibly also causing it to become brittle. Further, there is always the possibility of the push bar of the prior art device becoming detached from the latching member, thereby making it difficult if not impossible to actuate and release the clasp.

Figure 4A:
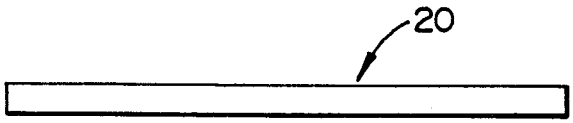
FIGS. 4A–4C are side, top and end views, respectively, of a flat metal strip that may be used as a starting blank for forming the catch according to one embodiment of the present invention.
Figure 4C:
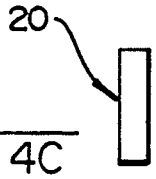
Figure 4B:
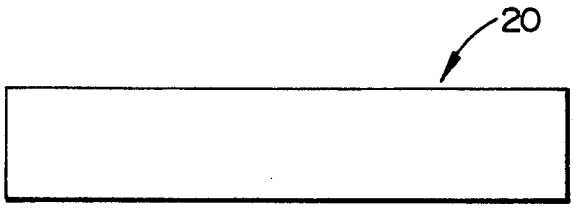

FIGS. 4A–4C are side, top and end views of flat metal strip 20 which is substantially rectangular and has substantially uniform length, width and thickness. Flat strip 20 is used as a starting blank in the first method of producing the catch of the present invention. Flat strip 20 may be stamped from a continuous roll of flat metal strip or is stamped and pressed from a roll of metal wire or stamped from any other convenient source of stock. Flat metal strip 20 is next placed in a die (not shown) and pressed to form a semi-blank as shown in FIGS. 5A–5C.

Figure 5A:
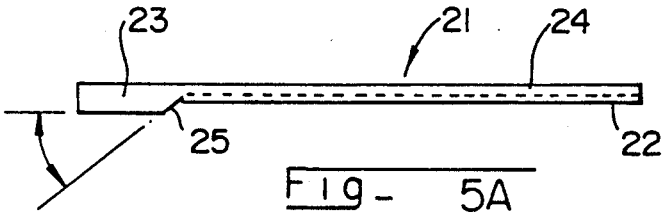
FIGS. 5A–5C are side, top and end views, respectively, of a semi-blank which is produced as an intermediate step in producing the catch of the invention according to the same embodiment referenced with regard to FIGS. 4A–4C.
Figure 5C:
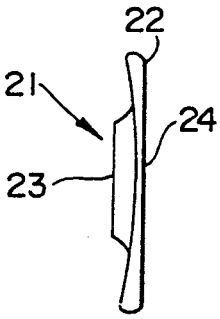
Figure 5B:
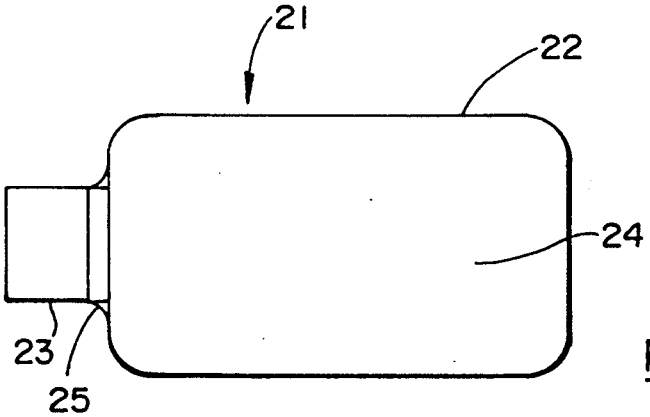

Semi-blank 21 roughly takes on the shape of a spoon, wherein the first thickness 22 which results from the pressing operation is not uniform in thickness, but thinner in the middle 24 as shown in FIGS. 5A and 5C. A second thickness 23 is equal to the thickness of starting blank 20 and is the thickness of the unpressed potion of the semi-blank. A bevel in the die forms the bevelled transition area 25 between the first and second thicknesses of the semi-blank. The bevel serves to reinforce the juncture between the two thicknesses as well as to provide a smooth transition between the two. The semi-blank, after pressing may optionally be annealed.

Figure 6A:
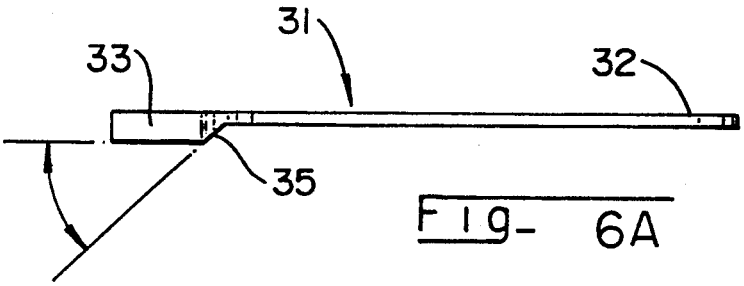
FIGS. 6A–6C are side, top and end views, respectively, of an approximate final blank that is used in the final blanking of the catch according to the present invention when produced according to the embodiment referenced above.
Figure 6C:
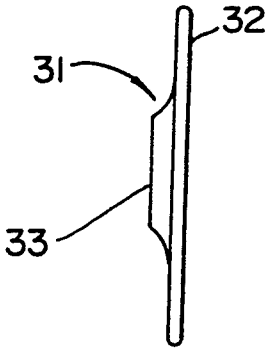
Figure 6B:
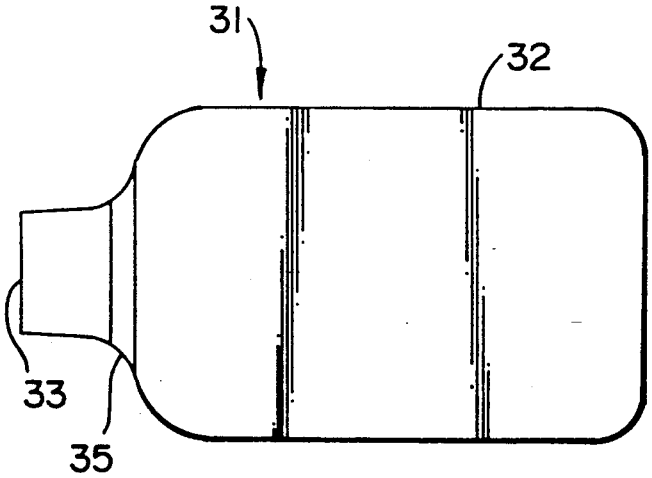

Semi-blank 21 is next placed into another die (not shown) having a slightly greater width than the first die. The spoon shape of the semi-blank is pressed flat to form an approximate final blank 31 as shown in FIGS. 6A–6C. The first thickness portion 32 of the approximate final blank has a substantially consistent thickness throughout. Unpressed portion 33 has a second thickness throughout, which is substantially equal to the thickness of the portion 23 of the semi-blank as well as the thickness of the starting blank. Bevel 35 forms an angle with the unpressed portion 33 of approximately 40 to 45 degrees, which is substantially to the bevel angle formed between bevel 25 and the unpressed portion of the semi-blank 23. The approximate final blank 31 may optionally be annealed before proceeding to the next method . step.

Approximate final blank is next "blanked out" or cut to the exact dimensions desired so that the final blank can be bent into a finished product, i.e. the final shape of the catch is cut out from the approximate final blank. The final blank is then bent as described above with reference to FIG. 1 to form a catch. It is repeated here for emphasis, that no soldering whatsoever is required to form the catch and therefore the spring force of the tongue is not diminished, nor does the tongue become brittle.

The above method uses pressing steps with pressures which are generally defined by the following empirically derived equation:

$$T\delta = \Sigma^{x}{}_{n=1} (1/PDt_n)$$

wherein:

$T_\delta$ = said difference in thickness in inches;

P = pressure in tons per square inch;

D = a measure of ductility of said blank in inches per ton second;

t = time in seconds;

n=index of current pressing step being carried out; and x=total number of pressing steps.

The method produces a catch having a second thickness which is about 1.5 to 5 times greater than the first thickness, preferably about 2 to 4 times greater than the first thickness, and most preferably around three times greater than the first thickness.

Figure 7A:
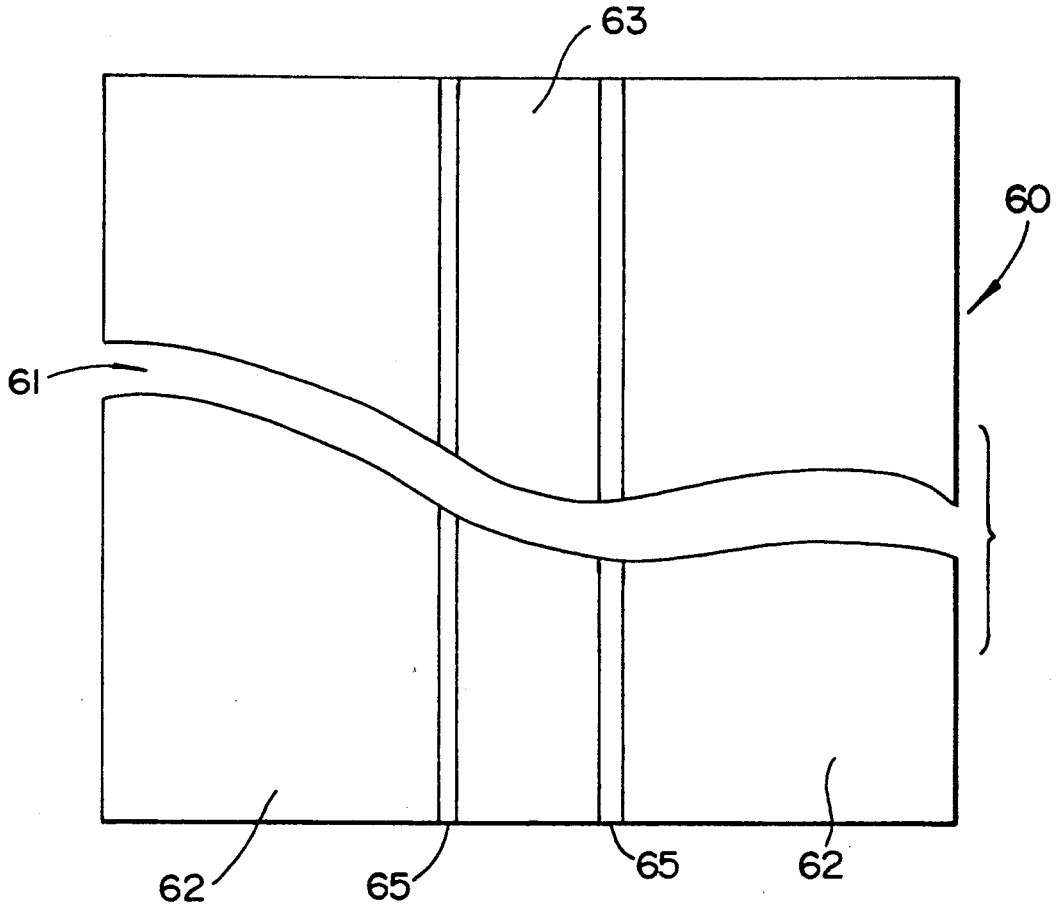
FIGS. 7A–7B are top and end views of a continuous ribbon of stock material from which blanks may be cut for producing the catch according to the present invention when produced according to a second embodiment.
Figure 7B:
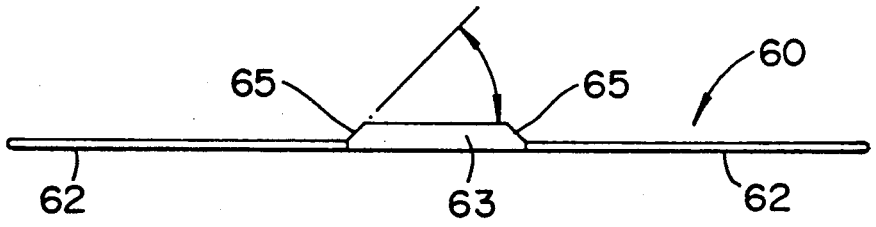

A second method of making a dual thickness catch for a clasp may be employed which includes cutting a strip of material from a sheet of stock material which has a first thickness portion and a second thickness portion to obtain a dual thickness strip. A ribbon of dual thickness stock material is depicted in FIG. 7A. A break in the figure at 61 indicates that dual thickness ribbons may be available in rolls or very long strips. Ribbon 60 includes first thickness portions 62 and second thickness portion 63 which are unitary with the first thickness portions. Bevelled areas 65 are located in the transition areas between first and second thicknesses. The bevels form approximately 40–45 degree angles with the second thickness surface 63, as shown in FIG. 7B.

A dual thickness strip having a width equal to the desired width of the catch to be produced is cut from the end of the ribbon to thereby provide a double blank, i.e., a blank having a pair of oppositely positioned first thickness parts 63 and a single second thickness part 62 therebetween. A second cut, which is substantially perpendicular to the first cut is made across the middle of the second thickness part 63 of the double blank to form two dual thickness strips or blanks of substantially equal proportions. The two substantially equal strips are final blanks which can be bent into catches, as described above with reference to FIG. 1.

The first thickness portion of each strip is bent to form a substantially V-shaped tongue wherein the portion of the metal strip having the second thickness is integral with one end of the V-shape. The second thickness portion is bent relative to the first thickness portion to form a pushing member, wherein the pushing member is substantially perpendicular to the tongue portion.

The second thickness portion is thicker than the first thickness portion, generally by 1.5 to 5 times, more particularly by 2 to 4 times and most preferably by around 3 times.

Figure 8:
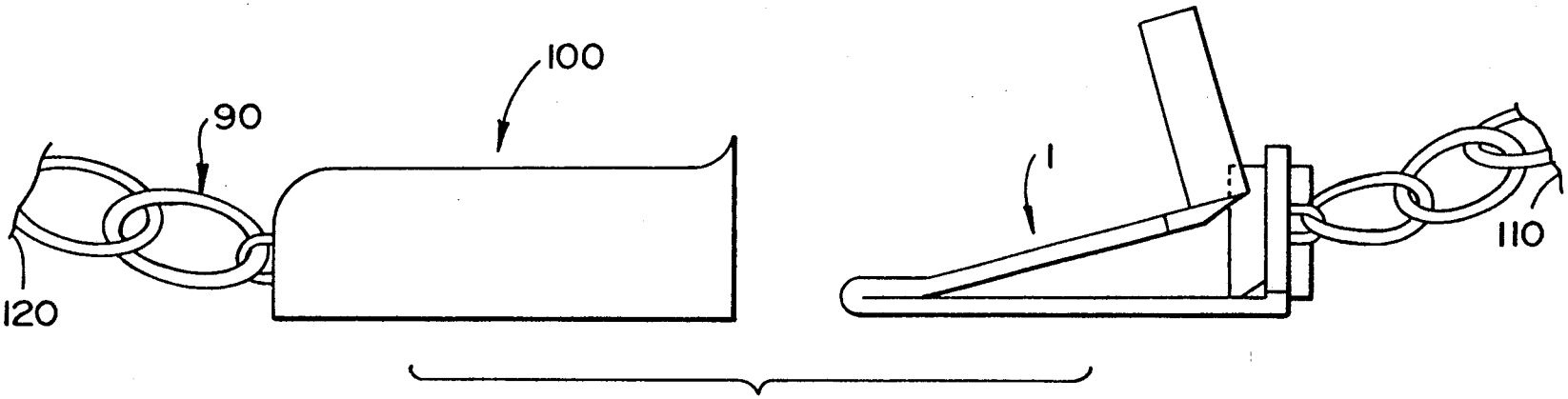
FIG. 8 is a plan view of an article of jewelry which includes a catch according to the present invention.

FIG. 8 shows an embodiment of an article of jewelry which is cut away at 110 and 120. Chain 90 is attached to keeper 100 and catch 1. Catch 1 is adapted to mate with keeper 100 to form a clasp which secures the article of jewelry to the wearer. The catch and keeper are not limited to use with a chain, but may be attached to a band, strap, or other ornamental article which may be worn as an article of jewelry.

The following is an example of forming a catch by the first method, described above. This example is in no way meant to limit the invention or disclosure, since many different sizes of catches can be and are produced by this method and since all of those sizes can also be produced by the other methods:

A starting blank of dimensions 0.675×0.130×0.036 inches is stamped from a roll of strip metal stock. The blank is then placed in a first die and a pressure of 25 tons/in$^2$ is applied to the blank for about 2 seconds. A semi-blank is removed from the die. The unpressed second thickness portion has a length of about 0.100 inches. The bevelled transition area 25 extends about 0.025 inches along the length of the semi-blank. The "spoon-shaped" portion of the semi-blank has a width of about 0.300 inches and a length of about 0.550 inches. The first thickness of the "spoon-shaped" portion is about 0.024 inches, while the thinner central region has a thickness of about 0.012 inches.

The semi-blank is next placed into a slightly wider die and pressed again with the same amount of pressure for about two seconds. The resultant approximate final blank has the same dimensions as the semi-blank except the width of the first thickness portion 32 is about 0.350 inches and the first thickness portion is about 0.012 inches thick throughout. The approximate final blank can next be cut to the exact final shape and dimensions of the catch and bent to into the final shape of the catch as described previously.

Finally, the following is a summary of forming a catch by the second method, described above. A strip of material is cut from stock material having at least a first thickness portion 62 and a second, greater thickness portion 63 to thereby form a substantially flat blank. Before bending portions of the blank, cuts are made to form, e.g., the recesses 6 and the greater width end member 5. Then the first thickness part 62 of the blank is bent intermediate of a first end of the blank and a transition area between the first thickness part and the second thickness part to form a bend 4, thereby creating a V-shaped tongue. The tongue has an overlying latching portion 3 and an underlying portion 2, the overlying portion extending in a direction from the bend 4 toward the second thickness part 63 and the underlying portion extending in a direction from the bend 4 toward the portion later to be bent into end member 5. Next, in an area of the transition between the first thickness part and the second thickness part, the blank is bent to form a pushing member 8 from the second thickness part 63, extending away from the first thickness part 62 and, more particularly, away from the underlying part 2 thereof.

Although the invention has been described with reference to particular means, materials and embodiments, it is to be understood that the invention is not limited to the particulars disclosed and extends to all equivalents within the scope of the claims.

What is claimed is:

1. A method of making a dual thickness catch for a clasp from a sheet of stock material having a first thickness portion and a second thickness portion, said second thickness portion having a greater thickness than said first thickness portion, said method comprising the steps of:

cutting a strip of material from the sheet of stock material to obtain a dual thickness trip in the form of a substantially flat blank said strip thereby having a first thickness part and a second thickness part being unitary and being demarcated by a transverse transition area, said second thickness part being thicker than said first thickness part, said first thickness part defining a first stripend and said second thickness part defining a second strip end;

bending said first thickness part at an area of said first thickness part intermediate of said first strip end and said transverse transition area to form a substantially V-shaped tongue with a bend, said V-shaped tongue having an underlying portion extending in a direction from said first strip end toward said bend and an overlying portion extending in a direction from said bend toward said transverse transition area; and bending said second thickness part relative to said first thickness part at said transverse transition area to form a pushing member that extends substantially perpendicular to said overlying portion of said V-shaped tongue and extends away from said underlying portion of said V-shaped tongue.

2. The method of claim 1, wherein said second thickness is about 1.5 to 5 times greater than said first thickness.

3. The method of claim 1, wherein said second thickness is about 2 to 4 times greater than said first thickness.

4. The method of claim 1, wherein said second thickness is about 3 times greater than said first thickness.

5. The method of claim 1, further comprising the step of bending an end member of said first thickness part, said end member including said first strip end, so that said end member extends away from said underlying portion of said V-shaped tongue.

6. The method of claim 5, further comprising, before the step of bending said first thickness part and before the step of bending said second thickness part, the step of cutting said first thickness part of said substantially flat blank proximate to said transverse transition area to form oppositely positioned locking recesses for cooperation with keeper to be engaged with said catch.

7. The method of claim 5, further comprising, before the step of bending said first thickness part and before the step of bending said second thickness part, the step of cutting said flat blank to provide said end member with a width greater than a width of said underlying member and a width greater than a width of said overlying member.

8. The method of claim 1, wherein the sheet of stock material further comprises an intermediate longitudinally extending second thickness portion and a pair of first thickness portions longitudinally extending on opposite sides of said intermediate longitudinally extending second thickness portion, and wherein said step of cutting a strip of material from the sheet of stock material comprises, firstly, cutting a strip of material transversely across said sheet of stock material to form a double blank having an intermediate second thickness part and a pair of first thickness parts on opposite sides of said second thickness part and, secondly, cutting said intermediate second thickness part to form two separate blanks having a single first thickness part and a single second thickness part.

* * * * *

UNITED STATES PATENT AND TRADEMARK OFFICE

CERTIFICATE OF CORRECTION

PATENT NO. : 5,309,616
DATED : May 10, 1994
INVENTOR(S) : Donald J. Sobin

It is certified that error appears in the above-indentified patent and that said Letters Patent is hereby corrected as shown below:

Title page, item [57], Abstract: line 12 change "disclose" to --disclosed--.
Column 2, line 61, change "$T_{67}$ to-- T --.

Column 6, line 45, delete "." after "method".
Column 8, line 51, change "trip" to --strip--.
Column 8, line 52, insert --,-- after "blank".
Column 8, line 57, change "stripend" to --strip end--.

Signed and Sealed this

Fourteenth Day of January, 1997

Bruce Lehman

*Attest:*

BRUCE LEHMAN

*Attesting Officer*

*Commissioner of Patents and Trademarks*